US006722651B2

(12) United States Patent
Fujisawa et al.

(10) Patent No.: US 6,722,651 B2
(45) Date of Patent: Apr. 20, 2004

(54) SHEET MEMBER DISCHARGE MECHANISM

(75) Inventors: Syuji Fujisawa, Osaka (JP); Kuniaki Araishi, Osaka (JP); Kazuhisa Kondo, Osaka (JP); Masuo Kawamoto, Osaka (JP); Yoshio Sugishima, Osaka (JP); Mitsuhiro Shibata, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 27 days.

(21) Appl. No.: 09/968,804

(22) Filed: Oct. 3, 2001

(65) Prior Publication Data

US 2002/0038936 A1 Apr. 4, 2002

(30) Foreign Application Priority Data

Oct. 4, 2000 (JP) ..... 2000-305480

(51) Int. Cl.[7] ..... B65H 31/26
(52) U.S. Cl. ..... 271/220; 271/207
(58) Field of Search ..... 271/207, 220

(56) References Cited

U.S. PATENT DOCUMENTS 4,575,069 A * 3/1986 Burkhart ..... 271/186
5,033,731 A * 7/1991 Looney ..... 271/176
5,249,793 A * 10/1993 Scheufler ..... 271/220
5,618,038 A * 4/1997 Hutson ..... 271/297
6,113,094 A * 9/2000 Horiguchi et al. ..... 271/176

FOREIGN PATENT DOCUMENTS

EP 0490272 A1 * 5/1991 ..... B65H/29/52
GB 2215313 A * 9/1989 ..... B65H/29/00
JP 59124651 A * 7/1984 ..... B65H/31/34
JP 59190156 A * 10/1984 ..... B65H/31/34
JP 63006872 A * 1/1988 ..... H01L/29/28
JP 63295364 A * 12/1988 ..... B65H/31/26
JP 01192664 A * 8/1989 ..... B65H/31/26
JP 02106551 A * 4/1990 ..... B65H/29/22
JP 03013454 A * 1/1991 ..... B65H/31/26
JP 05294530 A * 11/1993 ..... B65H/29/22

* cited by examiner

*Primary Examiner*—Donald P. Walsh
*Assistant Examiner*—Matthew J. Kohner
(74) *Attorney, Agent, or Firm*—Smith, Gambrell & Russell, LLP

(57) ABSTRACT

A sheet member discharge mechanism comprising an upper discharge roller and a lower discharge roller for conveying a sheet member in a predetermined direction while nipping it therebetween. A push-down member is disposed downstream of the nipping portion between the upper discharge roller and the lower discharge roller as viewed in a direction of conveying the sheet member, the push-down member being allowed to move between an ascended position and a descended position and is urged to the descended position. The push-down member is moved to the ascended position by the sheet member acting upon the push-down member while the sheet member is being conveyed by the upper discharge roller and the lower discharge roller that work in cooperation. The push-down member moves to the descended position to push down the trailing edge of the sheet member after the trailing edge of the sheet member has passed the nipping portion between the upper discharge roller and the lower discharge roller.

12 Claims, 6 Drawing Sheets

SHEET MEMBER DISCHARGE MECHANISM

BACKGROUND OF THE INVENTION

1. Field of the Invention

The present invention relates to a sheet member discharge mechanism that can be applied to image-forming machines such as copiers, printers and facsimiles.

2. Description of the Prior Art

In an image-forming machine such as a copier, a printer or a facsimile as is widely known, an image is formed on the sheet members which may be common papers, successively, and the sheet members are discharged onto a receiving member and are stacked thereon. At the end of the sheet member conveyer passage, there is disposed a sheet member discharge mechanism which includes an upper discharge roller and a lower discharge roller. The sheet member is conveyed in a predetermined direction being nipped between the upper discharge roller and the lower discharge roller, and is discharged onto a receiving means disposed under the sheet member discharge mechanism.

The sheet members discharged and stacked on the receiving means are, as required, corrected for their stacked state and, in many cases, are, further, conveyed through a predetermined conveyer passage. In particular, when the sheet members discharged and stacked on the receiving means are further conveyed through a predetermined passage, the receiving member constituting the receiving means is set to be as short as possible (to be slightly longer than, for example, a maximum length of the sheet member that is discharged) in the direction in which the sheet members are discharged from the standpoint of realizing the image-forming machine in a compact size. Besides, the upstream end of the receiving member is positioned under the lower discharge roller as viewed in the direction of discharge of the sheet members without separating the receiving member toward the downstream in the direction of discharge from the upper discharge roller or the lower discharge roller. According to this constitution, the trailing edge of the sheet member that has passed the nipping portion between the upper discharge roller and the lower discharge roller, must further move downward along the peripheral surface of the lower discharge roller to arrive at the upstream end of the receiving member located under the lower discharge roller. According to the conventional mechanism for conveying the sheet members, however, slipping occurs between the trailing edge of the sheet member and the peripheral surface of the lower discharge roller; i.e., the trailing end of sheet member fails to move along the peripheral surface of the lower discharge roller and tends to stay covering the upper peripheral surface of the lower discharge roller. Should that happen, the next sheet member is interrupted from being discharged and, besides, it becomes difficult to correct the stacked state of the discharged sheet members.

SUMMARY OF THE INVENTION

It is therefore an object of the present invention to provide a novel and improved sheet member discharge mechanism which is capable of reliably lowering the trailing edge of a sheet member down to an upstream end of a receiving member positioned under a lower discharge roller by moving the trailing edge of the sheet member along the peripheral surface of the lower discharge roller after the trailing edge of the sheet member has passed a nipping portion between an upper discharge roller and the lower discharge roller.

In order to accomplish the above-mentioned object, the present invention provides a sheet member discharge mechanism comprising an upper discharge roller and a lower discharge roller for conveying a sheet member in a predetermined direction while nipping it therebetween; wherein at least one push-down member is disposed downstream of the nipping portion between said upper discharge roller and said lower discharge roller as viewed in a direction of conveying the sheet member, said push-down member being allowed to move between an ascended position and a descended position and is urged to said descended position; and said push-down member is moved to said ascended position by said sheet member acting upon said push-down member while the sheet member is being conveyed by said upper discharge roller and said lower discharge roller that work in cooperation, and said push-down member moves to said descended position to push down the trailing edge of the sheet member after the trailing edge of the sheet member has passed the nipping portion between said upper discharge roller and said lower discharge roller.

It is desired that said push-down member is extending toward the downstream being inclined downward from above the nipping portion between said upper discharge roller and said lower discharge roller down to below the nipping portion thereof at both said ascended position and said descended position.

Preferably, the lower surface of said push-down member includes an upstream portion and a downstream portion which extends toward the downstream being inclined downward at a predetermined bending angle $\alpha$which is from 10 to 30 degrees with respect to said upstream portion; when said push-down member is at said ascended position, said upstream portion on the lower surface of said push-down member extends toward the downstream being inclined downward at an inclination angle $\beta 1$ of from 10 to 30 degrees, and said downstream portion extends toward the downstream being inclined downward at an inclination angle $\gamma 1$ of from 20 to 60 degrees; and when said push-down member is at said descended position, said upstream portion on the lower surface of said push-down member extends toward the downstream being inclined downward at an inclination angle $\beta 2$ of from 30 to 50 degrees, and said downstream portion extends toward the downstream being inclined downward at an inclination angle $\gamma 2$ of from 40 to 80 degrees.

It is desired that when said push-down member is brought to said descended position, the tip of said push-down member is located at a position which is lower than a center axis of said lower discharge roller but is higher than the lowermost end of said lower discharge roller and when said push-down member is brought to said ascended position, the tip of said push-down member is located at a position lower than said nipping portion between said upper discharge roller and said lower discharge roller but is higher than the center axis of said lower discharge roller.

It is desired that said push-down member is urged to said descended position by its own weight.

The push-down member may have a rectangular shape and can be formed of a synthetic resin plate.

Plural ribs can be formed on at least the upstream portion on the lower surface of said push-down member, the plural ribs extending in the direction of conveying the sheet member maintaining a distance in the direction of width.

It is desired that the push-down member is mounted to swing about a center axis thereof which is substantially in agreement with the center axis of said upper discharge roller.

Desirably, when said push-down member is brought to said descended position, the lower surface of said push-down member comes in contact with the lower discharge roller, whereby said push-down member is prevented from swinging in excess of said descended position.

The push-down member can be arranged in a plural number maintaining a distance in the direction of width.

DETAILED DESCRIPTION OF THE PREFERRED EMBODIMENTS

Preferred embodiments of the sheet member discharge mechanism constituted according to the present invention will be described in further detail with reference to the accompanying drawings.

Figure 1:
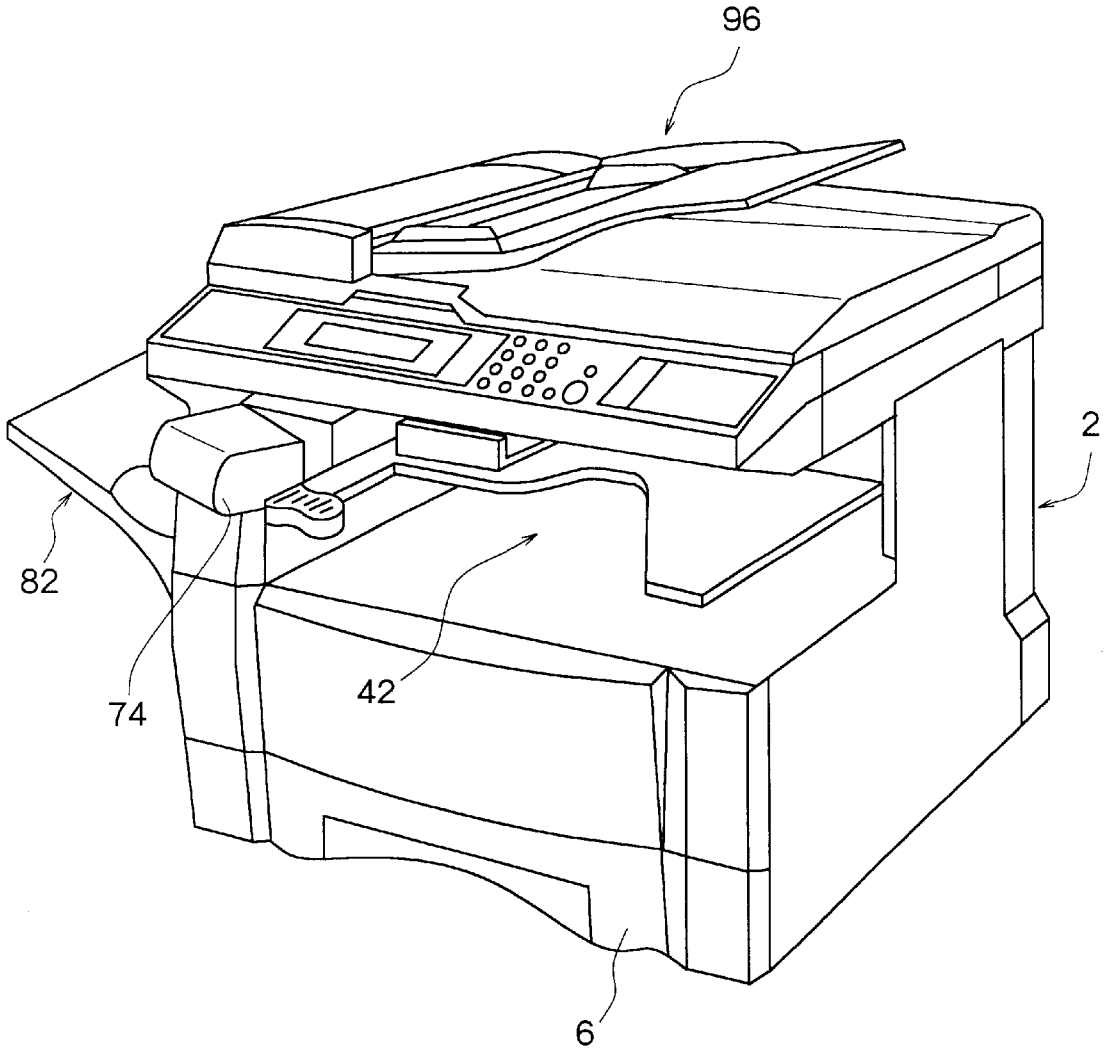
FIG. 1 is a perspective view illustrating an image-forming machine equipped with a sheet member discharge mechanism constituted according to the present invention.
Figure 2:
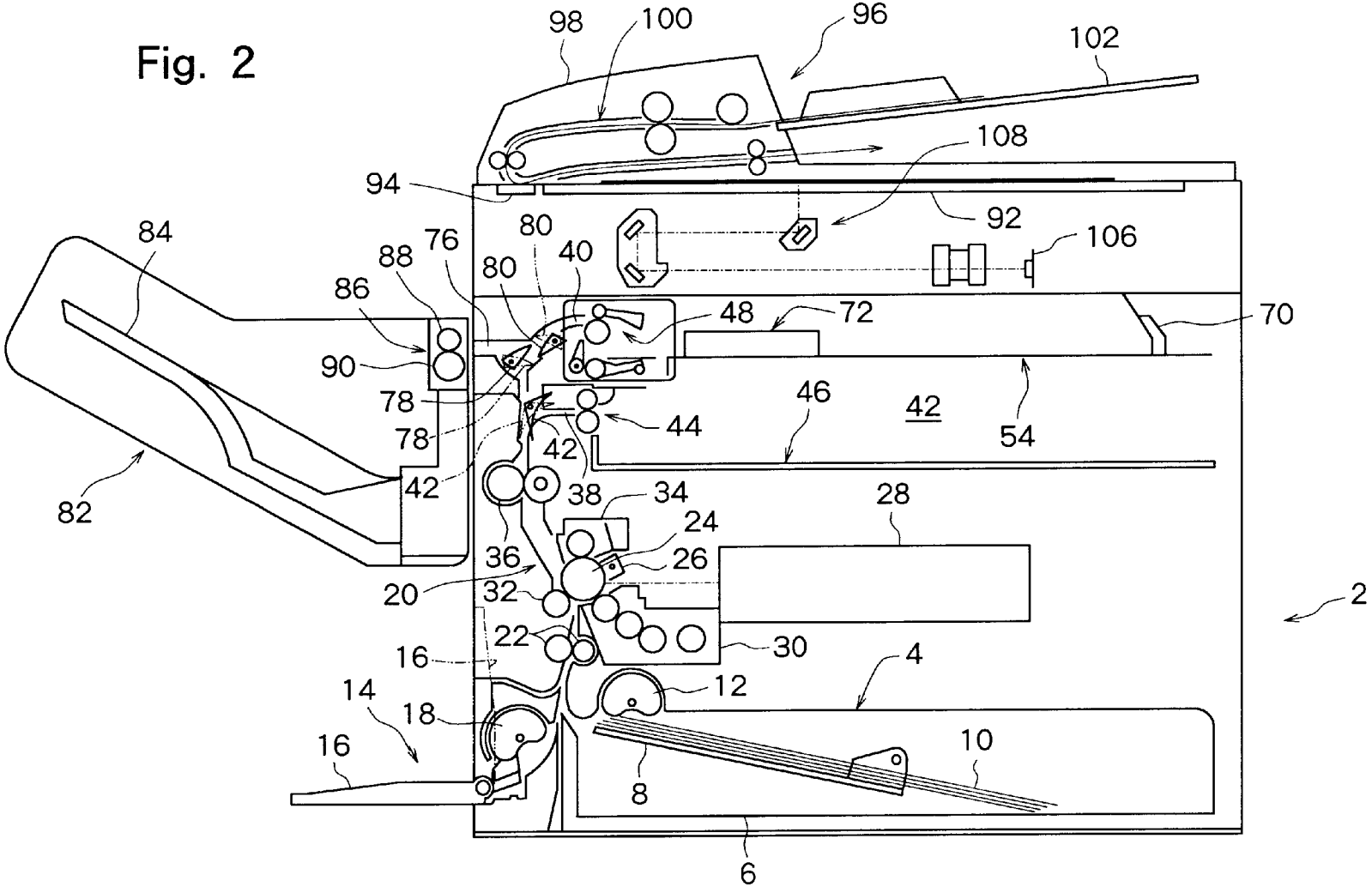
FIG. 2 is a sectional view schematically illustrating the image-forming machine shown in FIG. 1.

FIGS. 1 and 2 are diagrams illustrating an image-forming machine equipped with the sheet member discharge mechanism constituted according to the present invention. The diagramed image-forming machine is equipped with a housing 2 which, as a whole, is of a rectangular parallelopiped shape. An automatic sheet member feeding means 4 is disposed under the housing 2. The automatic feeding means includes a cassette container 6 which is allowed to freely move between an acting position in the housing 2 and a non-acting position drawn forward from the housing 2 in the back-and-forth direction (in a direction perpendicular to the surface of the paper in FIG. 2). A placing plate 8 is arranged in the cassette container 6, and plural pieces of sheet members 10 are placed on the placing plate 8 being stacked one upon the other. The sheet members 10 may be common papers. The automatic feeding means 4 includes a feed roller 12. When the feed roller 12 rotates clockwise in FIG. 2, the sheet members 10 are delivered piece by piece from the cassette container 6 onto a sheet member conveyer passage that will be described later.

If further described with reference to FIG. 2, the diagramed image-forming machine further has a manual sheet member feeding means 14 disposed therein. The manual feeding means 14 includes a placing table 16 which can be selectively brought to an acting position indicated by a solid line in FIG. 2 and to a non-acting position indicated by a two-dot chain line, and a feed roller 18. When the feed roller 18 is rotated counterclockwise in FIG. 2 in a state where the placing table 16 is brought to the acting position and a piece or plural pieces of sheet members 10 are placed in a stacked manner on the placing plate 16, then, the sheet members 10 are delivered piece by piece from the placing table 16 onto the sheet member conveyer passage that will be described later.

A sheet member conveyer passage 20 is defined on one side portion of the housing 2 or in the left side portion in FIG. 2 extending upward from the feeding ends of the automatic feeding means 4 and of the manual feeding means 14. The sheet member conveyer passage 20 can be defined by a suitable guide plate or the like. A pair of resist rollers 22 are arranged in the upstream portion of the sheet member conveyer passage 20, and a rotary drum 24 is mounted on the downstream of the pair of resist rollers 22. An electrostatic photosensitive material is arranged on the peripheral surface of the rotary drum 24. An electric charging means 26, an image exposure means 28, a developing means 30, a transfer means 32 and a cleaning means 34 are arranged in the housing 2 in connection with the rotary drum 24 that rotates clockwise in FIG. 2. As the rotary drum 24 rotates clockwise in FIG. 2, the peripheral surface of the rotary drum 24 is uniformly charged electrically to a particular polarity due to the charging means 30 that can be constituted by a corona discharger. Then, the peripheral surface of the rotary drum 24 is exposed to light from the image exposure means 28 in compliance with a picture that is to be formed, so that an electrostatic latent image is formed on the peripheral surface of the rotary drum 24. The image exposure means 28 may be a laser beam-generating means (not shown). The peripheral surface of the rotary drum 24 is selectively exposed to light in compliance with picture signals sent from an image reading means that will be described later mounted on the image-forming machine, or in compliance with picture signals sent from a personal computer or a facsimile separate from the image-forming machine. The developing means 30 applies the toner onto the electrostatic latent image on the rotary drum 24 to develop it into a toner image. The pair of resist rollers 22 is driven as desired in synchronism with the rotation of the rotary drum 24, and conveys the sheet member 10 delivered from the automatic feeding means 4 or the manual feeding means 14 through between the rotary drum 24 and the transfer means 32. The toner image on the rotary drum 24 is transferred onto the sheet member 10 due to the action of the transfer means 32 which can be constituted by a roller applied with a transfer voltage. The cleaning means 34 removes the toner remaining on the peripheral surface of the rotary drum 24 after the transfer of image, so that the toner image can be formed on the peripheral surface of the rotary drum 24 in the next step of forming a picture.

A fixing means 36 that can be constituted by a pair of fixing rollers is disposed on the downstream of the rotary drum 24 in the sheet member conveyer passage 20. The toner image transferred onto the sheet member 10 is fixed on the sheet member due to heating and/or pressurization by the fixing means 36.

Downstream of the fixing means 36, the sheet member conveyer passage 20 is branched into a first branched conveyer passage 38 and a second branched conveyer passage 40. At a branching portion is disposed a conveyance control member 42 that will be selectively brought to a first position indicated by a solid line in FIG. 2 and to a second position indicated by a two-dot chain line in FIG. 2. When the conveyance control means 42 is brought to the first position, the sheet member 10 sent from the fixing means 36 is guided to the first branched conveyer passage 38. When the conveyance control means 42 is brought to the second position, the sheet member 10 sent from the fixing means 36 is guided to the second branched conveyer passage 40.

As will be clearly understood with reference to FIG. 2 together with FIG. 1, an open space 42 is defined in nearly the intermediate portion in the up-and-down direction of the housing 2, and has a front surface and one side surface (right surface in FIG. 2) which are opened. The final end of the first branched conveyer passage 38 is positioned on the other side of the open space 42 (i.e., on the left side in FIG. 2). A first sheet member discharge mechanism 44 constituted by a pair of discharge rollers is disposed at a downstream end of the first branched conveyer passage 38. Further, a first sheet member receiving means 46 is disposed in the open space 42. The first receiving means 46 is constituted by a member having a main portion which extends substantially horizontally under and downstream of the sheet member discharge mechanism 44. The sheet member 10 introduced into the first branched conveyer passage 38 is discharged by the sheet member discharge mechanism 44 onto the first receiving member 46 and is stacked thereon.

The final end of the second branched conveyer passage 40 is positioned over the final end of the first branched conveyer passage 38. At the final end of the second branched conveyer passage 40, there is disposed a second sheet member discharge mechanism 48 including upper discharge rollers 50*a*, 50*b* (see FIG. 5) and lower discharge rollers 52*a* to 52*d* (see FIG. 5). In the diagramed embodiment, the second sheet member discharge mechanism 48 is constituted according to the present invention. The constitution of the second sheet member discharge mechanism 48 will be described later in further detail. If further described with reference to FIGS. 2 and 3, in the open space 42 is disposed a second sheet member receiving means 54 extending substantially horizontally over the final end of the first branched conveyer passage 38 but under the final end of the second branched conveyer passage 40. In the diagramed embodiment, the second sheet member receiving means 54 is constituted by two members 56 and 58. The member 56 has a main portion which extends substantially horizontally under the second sheet member discharge mechanism 48, i.e., which extends from the upstream of the second sheet member discharge mechanism 48 through up to the downtream thereof. As will be understood with reference to FIG. 2, the one end of the member 56 (inclined portion and hanging portion at the left end in FIG. 2) is defining a portion of the second branched conveyer passage 40. The main portion of the member 58 extends substantially horizontally toward the downstream maintaining a small distance with respect to the main portion of the member 56 as viewed in the direction in which the sheet member 10 is discharged. As will be further described later, the sheet member 10 introduced into the second branched conveyer passage 40 is discharged by the second sheet member discharge mechanism 48 onto the second sheet member receiving means 54.

If further described with reference to FIGS. 2 and 3, the second sheet member receiving means 54 has at its front end (left side of the second sheet member discharge mechanism 48 in FIGS. 2 and 3) a restriction piece 60 which is selectively brought to an acting position indicated by a solid line and a non-acting position indicated by a two-dot chain line. When brought to the acting position, the restriction piece 60 protrudes upward through an opening 62 formed in the main portion of the member 56 and when brought to the non-acting position, the restriction piece 60 retracts downward beneath the main portion of the member 56. As clearly shown in FIG. 3, a discharge roller 64 is disposed immediately after the restriction piece 60. A support shaft 66 is disposed under the member 56 and extends in the direction of width (in a direction perpendicular to the surface of the paper in FIG. 3). A bracket 68 is mounted on the support shaft 66 to swing, and a delivery roller 64 is mounted on the bracket 68 to rotate. The bracket 68 and the delivery roller 64 mounted thereon are selectively brought to a non-acting position indicated by a solid line in FIG. 3 and to an acting position indicated by a two-dot chain line in FIG. 3. When brought to the non-acting position, the delivery roller 64 is retracted downward beneath the main portion of the member 56. When brought to the acting position, the delivery roller 64 protrudes upward through the opening 62 formed in the main portion of the member 56, and works in cooperation with the lower discharge rollers 42*a* to 52*d* of the second sheet member discharge mechanism 48.

If described with reference to FIG. 2, the second sheet member receiving means 54 further includes a pushing means 70 and a width restricting means 72. The pushing means 70 has a pushing piece that protrudes upward beyond the upper surface of the member 58, the pushing piece being driven by a suitable driving means (not shown) to move in a direction in which the member 58 is extending (right-and-left direction in FIG. 2). The width restricting means 72 includes a pair of width restricting pieces (only one piece is shown in FIG. 2) arranged on the surface of the member 58 maintaining a distance in the direction of width (direction perpendicular to the surface of the paper in FIG. 2). The pair of width restricting pieces is moved by a suitable driving means (not shown) in the direction of width.

In the diagramed embodiment as shown in FIG. 1, a staple means 74 is disposed on one side portion (front side portion) at the front end of the second sheet member receiving means 54. If further described with reference to FIGS. 1 and 2, there is further arranged, in the diagramed embodiment, a sheet member discharge passage 76 that extends substantially horizontally from the front end of the second sheet member receiving means 54 traversing the second branched conveyer passage 40. Conveyance control members 78 and 80 are disposed at a portion where the discharge passage 76 intersects the second branched conveyer passage 40 so as to be selectively brought to a first position indicated by solid lines and to a second position indicated by two-dot chain lines. When the conveyance control members 78 and 80 are brought to the first position indicated by solid lines in FIG. 2, the sheet member 10 introduced into the second branched conveyer passage 40 is conveyed through the second branched conveyer passage 40 as described above and is discharged onto the second sheet member receiving means 54 by the second sheet member discharge mechanism 48. When the conveyance control members 78 and 80 are brought to the second position indicated by the two-dot chain lines, on the other hand, the sheet member 10 on the second sheet member receiving means 54 is conveyed through the discharge passage 76 (such a conveyance of the sheet member 10 will be further described later). A sheet member receiving unit 82 is detachably mounted on one side surface of the housing 2 (on the left side surface in FIG. 2). In the unit 82 are disposed a receiving member 84 extending being inclined upward from one side surface of the housing 2 and a third sheet member discharge mechanism 86 for receiving the sheet member 10 sent through the discharge passage 76 and for discharging it onto the receiving member 84. The third sheet member discharge mechanism 86 includes an upper discharge roller 88 and a lower discharge roller 90.

If described with reference to FIGS. 2 and 3, the sheet member 10 introduced into the second branched conveyer passage 40 as described above is discharged onto the second sheet member receiving means 54 by the action of the second sheet member discharge mechanism 48. At this moment, the restriction piece 60 is brought to the acting position indicated by the solid line in FIGS. 2 and 3, and the discharge roller 64 is brought to the non-acting position indicated by the solid line in FIG. 3. Every time when the sheet member 10 is discharged onto the second sheet member receiving means 54 (or after plural pieces of sheet members 10 are discharged), the pushing means 70 moves forward (toward the left in FIGS. 2 and 3) to urge the discharged sheet members 10 forward, so that the edges on one side of the sheet members 10 are brought into contact with the restriction pieces 60. Then, the pushing means 70 is moved back and is returned to the standby position. The pair of width restriction pieces of the width restricting means 72, then, move in the direction of width to approach each other so as to act upon both side edges of the sheet members 10 to bring the sheet members 10 to a predetermined position in the direction of width. Required number of pieces of sheet members 10 are discharged onto the second sheet member receiving means 54, the edges on one side of the sheet members 10 are brought into contact with the restriction piece 60, and the sheet members 10 are arranged uniformly at a predetermined position in the direction of width. Then, as required, the sheet members 10 in the stacked state are moved in the direction of width by the action of the width restricting means 72, predetermined portions of the sheet members 10 are brought to the acting position of the staple means 74, and the sheet members 10 in the stacked state are stapled by the action of the staple means 74. Thereafter, due to the action of the width restricting means 72, the sheet members 10 in the stacked state are returned back to the predetermined position in the direction of width. Thereafter, the restriction piece 60 moves to the non-acting position, the delivery roller 64 is moved to the acting position, and the conveyance control members 78 and 80 are moved to the second position indicated by the two-dot chain lines in FIG. 2. Then, the sheet members 10 in the stacked state are conveyed through the discharge passage 76 due to the lower discharge roller of the second sheet member discharge mechanism 48 and the delivery roller 64 that work in cooperation together, and are discharged onto the receiving member 84 due to the action of the third sheet member discharge mechanism 86. In discharging the stacked plural sheet members 10 successively onto the receiving member, the position may be suitably deviated in the direction of width for every sheet member.

If further described with reference to FIGS. 1 and 2, two pieces of transparent plates 92 and 94 are disposed on the upper surface of the housing 2. The transparent plate 92 is of a relatively large rectangular shape and is arranged at a central portion on the upper surface of the housing 2. The transparent plate 94 is narrowly extending in the direction of width along one side portion (left side portion in FIG. 2) on the upper surface of the housing 2. Further, a moving frame 96 is disposed on the upper surface of the housing 2 to turn between a closed position (position shown in FIGS. 1 and 2) where it covers the transparent plates 92 and 94, and an open position where it opens the transparent plates 92 and 94. A casing 98 having an open lower surface is formed on one side portion of the moving frame 96 (left side portion in FIG. 2). In the casing 98 is defined a document conveyer passage 100 by arranging plural conveyer rollers. The casing 98 further has a document-placing table 102 connected to the upstream end of the document conveyer passage 100. The downstream end of the document conveyer passage 100 is connected to the upper surface of the main portion (portion other than the casing 98) of the moving frame 96. On the housing 2 are further disposed a document reading means 106 having many CCDs, and an optical means 108 which scans the document placed on the transparent plate 92, projects the picture to the picture reading means 106, and projects the image of the document that moves on the transparent plate 94 onto the document reading means 106.

The above-mentioned constitution and action of the image-forming machine that is shown are merely only those of a typical example of the image-forming machine to which the sheet member discharge mechanism constituted according to the present invention can be applied. Therefore, the above-mentioned constitution and action may be those that have been known among people skilled in the art. Therefore, the constitution and action thereof are not described in further detail in this specification.

In the diagramed image-forming machine as described above, the sheet member discharge mechanism constituted according to a preferred embodiment of the present invention is employed as the second sheet member discharge mechanism 48. If now described with reference to FIGS. 3 and 4 as well as FIG. 5, the second sheet member discharge mechanism 48 includes a lower support shaft 112 that is mounted to rotate. The lower support shaft 112 which extends substantially horizontally is drive-coupled to a rotary drive source (not shown) which may be an electric motor through a suitable transmission means (not shown), and is driven to rotate clockwise in FIGS. 3 and 4. Four lower discharge rollers 52*a*, 52*b*, 52*c* and 52*d* are secured to the lower support shaft 112 maintaining a suitable distance in the axial direction. The lower discharge rollers 52*a*, 52*b*, 52*c* and 52*d* can be formed of a suitable synthetic resin or a synthetic rubber. The lower discharge rollers 52*a* and 52*d* located on both sides in the axial direction are relatively long in the axial direction, the lower discharge roller 52*b* is relatively short in the axial direction, and the lower discharge roller 52*c* has an intermediate length in the axial direction. Circular truncated cone-shaped portions 114*a*, 114*c* and 114*d* are existing on the inside of the lower discharge roller 52*a* in the axial direction, on the inside of the lower discharge roller 52*c* in the axial direction and on the inside of the lower discharge roller 52*d* in the axial direction, the circular truncated cone-shaped portions 114*a*, 114*c* and 114*d* having an outer diameter that gradually decreases toward the inside in the axial direction. A minimum outer diameter of the circular truncated cone (i.e., outer diameter at the inner end in the axial direction) is substantially the same as the outer diameter of the lower support shaft 112. Due to the action of the second sheet member discharge mechanism 48, the sheet member 10 is discharged onto the second sheet member receiving means 54 and is stacked thereon as described above, and one edge of the sheet member 10 is positioned under the lower discharge rollers 52*a* to 52*d*. The stacked sheet members 10 are moved in the direction of width by the action of the width restricting means 72. In the diagramed embodiment, one edge 10*a* of the sheet member 10 moves on the lower left side of the position indicated by the two-dot chain line in FIG. 5, and the other edge 10*b* of the sheet member 10 moves on the upper right side of the position indicated by the two-dot chain line in FIG. 5. Since the circular truncated cone-shaped portions 114*a*, 114*c* and 114*d* are formed on the inside of the lower discharge rollers 52*a*, 52*c* and 52*d* in the axial direction, the side edge 10*a* and/or 10*b* of the sheet member 10 does not come in contact with the side surfaces of the lower discharge rollers 52*a*, 52*c* and 52*d* at the time when the sheet member 10 is moved in the direction of width, and the sheet member 10 is allowed to very smoothly move in the direction of width without being hindered. As will be clearly understood with reference to FIGS. 5 and 6, in each cylindrical main portion of the lower discharge rollers 52*a* and 52*d*, there are formed two recessed portions 116*a* and 116*d* extending in the axial direction maintaining a distance in the circumferential direction. Further, steps 117*a* and 117*d* are formed at the rear ends of the recessed portions 116*a* and 116*d* of the lower discharge rollers 52*a* and 52*d* as viewed in the direction of rotation. As will be understood with reference to FIG. 6, the steps 117*a* and 117*d* engage with the trailing end of the sheet member 10 after the trailing end of the sheet member 10 discharged by the sheet member discharge mechanism 48 has passed the nipping portion between the lower discharge rollers 52*b*, 52*c* and the upper discharge rollers 50*a*, 50*b*, in order to forcibly move the trailing end of the sheet member 10 along the peripheral surfaces of the lower discharge rollers 52*a* and 52*d*. As desired, the lower discharge rollers 52*a* and 52*d* may be provided with only one recessed portion 116*a* and only one recessed potion 116*d*, respectively, or may be provided with three or more recessed portions 116*a* and 116*d*, respectively, maintaining a distance in the circumferential direction.

Figure 5:
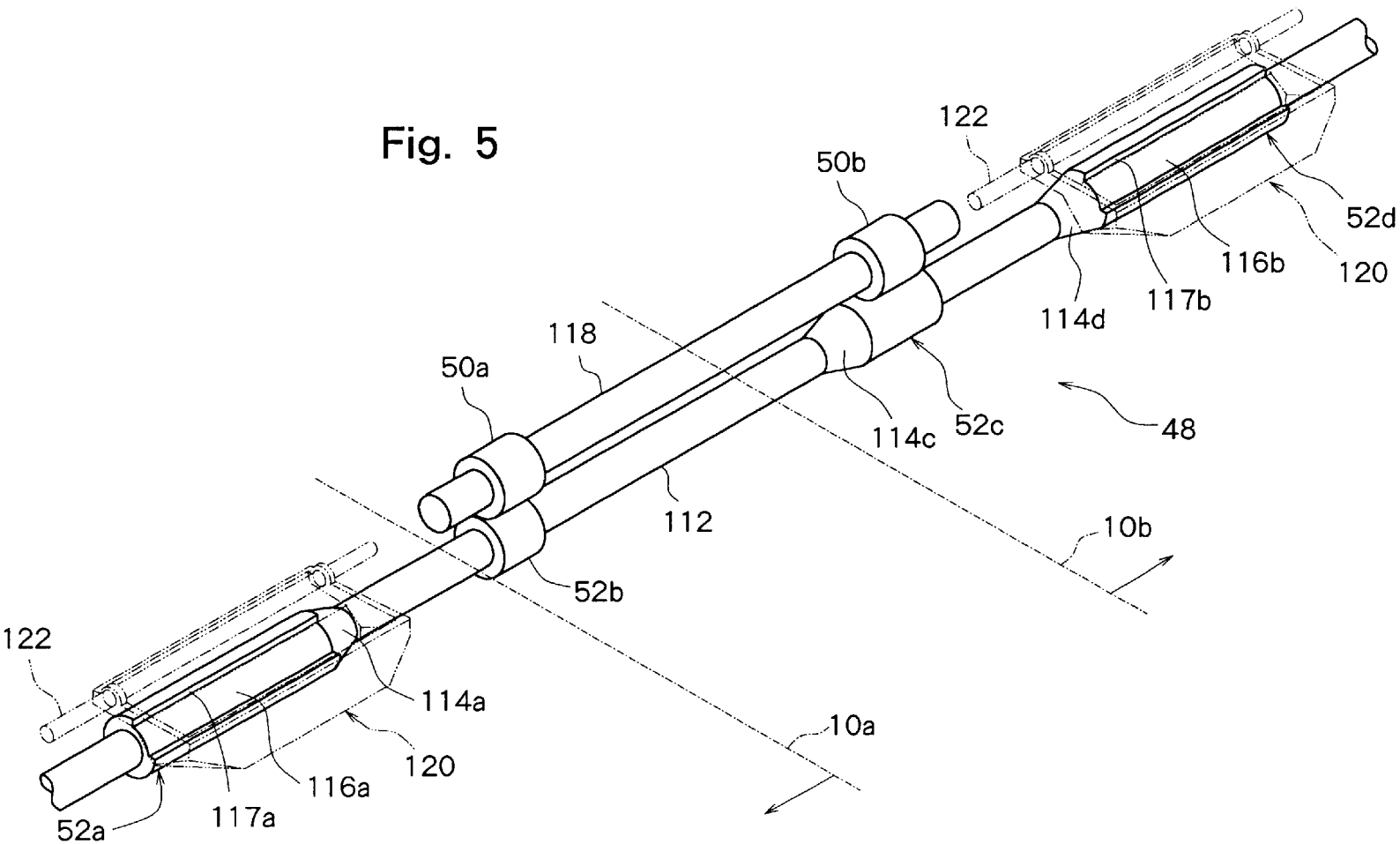
FIG. 5 is a perspective view illustrating the sheet member discharge mechanism shown in FIG. 3.
Figure 6:
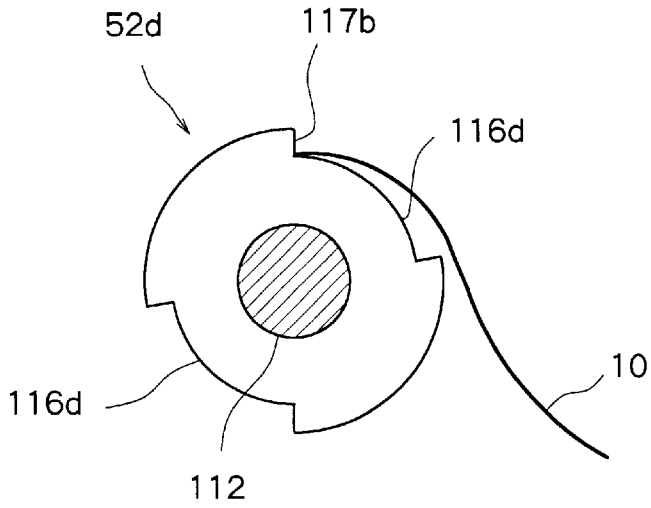
FIG. 6 is a sectional view illustrating the lower discharge roller in the sheet member discharge mechanism shown in FIG. 3.

If further described with reference to FIG. 5, an upper support shaft 118 is arranged over the lower support shaft 112. The upper support shaft 118 is shorter than the lower support shaft 112, and is positioned facing the central portion of the lower support shaft 112 in the axial direction. The upper support shaft 118 is supported by a suitable support means (not shown) to move up and down over a predetermined range, and is resiliently urged downward by a suitable resilient member(not shown). Two upper discharge rollers 50*a* and 50*b* are mounted on the upper support shaft 118 to rotate maintaining a distance in the axial direction. As the upper support shaft 118 is resiliently urged downward, the upper discharge rollers 50*a* and 50*b* are resiliently pushed onto the lower discharge rollers 52*b* and 52*c*. The upper discharge rollers 50*a* nd 50*b* can be formed of a suitable synthetic resin or a synthetic rubber.

It is important that the second sheet member discharge mechanism 48 constituted according to the present invention has at least one push-down member 120. In the diagramed embodiment, support shafts 122 are secured on both sides of the upper support shaft 118 in the axial direction. The push-down member 120 is mounted on each support shaft 122 to swing. If further described with reference to FIGS. 5 and 7, each push-down member 120 that can be formed of a suitable synthetic resin has a rectangular shape as a whole, and possesses ring-like portions 124 at the upstream ends on both sides thereof. With the ring-like portions 124 being fitted to the support shaft 122, the push-down member 120 is mounted on the support shaft 122 to swing. The center axis of the support shaft 122 on which the push-down member 120 is mounted is substantially in agreement with the center axis of the upper support shaft 118 on which the upper discharge rollers 50*a* and 50*b* are mounted. Accordingly, the center axis of swing of the push-down member 120 is substantially in agreement with the center axis of rotation of the upper discharge rollers 50*a* and 50*b*. The lower surface of the push-down member 120 includes an upstream portion 126 and a downstream portion 128 that are bent relative to each other maintaining a predetermined bending angle $\alpha$. The bending angle $\alpha$ may be from 10 to 30 degrees. It is desired that plural ribs 130 are formed on the upstream portion 126 on the lower surface of the push-down member 120 maintaining a distance in the direction of width. As will be further described later, when the sheet member 10 is discharged through the second sheet member discharge mechanism 48, the leading edge of the sheet member 10 is brought into contact with the upstream portion 126 on the lower surface of the push-down member 120. Due to the presence of ribs 130, however, the coefficient of friction is lowered between the leading edge of the sheet member 10 and the upstream portion 126, and the leading edge of the sheet member 10 smoothly proceeds onto the downstream portion 128 from the upstream portion 126 on the lower surface of the push-down member 120. Inclined surfaces 132 are formed on both sides of the downstream end, i.e., on both sides of the free end on the lower surface of the push-down member 120, and are extending toward both side edges being inclined upward.

Figure 7:
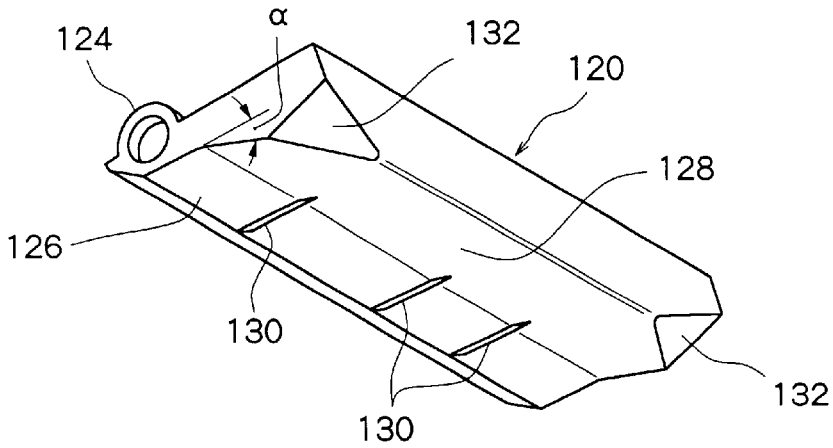
FIG. 7 is a perspective view illustrating a push-down member in the sheet member discharge mechanism shown in FIG. 3.

If further described with reference to FIGS. 5 and 7 together with FIGS. 3 and 4, the push-down member 120 is urged clockwise, i.e., downward in FIGS. 3 and 4 due to its own weight, and is brought to the descended position shown in FIG. 4 when no sheet member 10 has been discharged through the second sheet member discharge mechanism 48. At the descended position, the upstream portion 126 on the lower surface of the push-down member 120 is brought into contact with the lower discharge rollers 52*a* and 52*b*, and the push-down member 120 is prevented from further swinging clockwise or downward. At the descended position shown in FIG. 4, the push-down member 120 is extending toward the downstream being inclined downward from above the nipping portion between the upper discharge rollers 50*a*, 50*b* and the lower discharge rollers 52*b*, 52*c* down to below the nipping portion. The upstream portion 126 on the lower surface of the push-down member 120 is extending toward the downstream (toward the right in FIG. 4) being inclined downward at an inclination angle $\beta 2$ which is desirably from 30 to 50 degrees, and the downstream portion 128 is extending toward the downstream at an inclination angle $\gamma 2$ which is desirably from 40 to 80 degrees. It is desired that the downstream end or the free end of the push-down member 120 is lower than the nipping portion between the upper discharge rollers 50*a*, 50*b* and the lower discharge rollers 52*b*, 52*c* but is positioned higher than the lowermost end of the lower discharge rollers 52*a* to 52*d*.

Summarized below are the actions of the sheet member discharge mechanism 48 equipped with the push-down member 120. As the sheet member 10 introduced into the second branched conveyer passage 40 starts discharged by cooperation of the upper discharge rollers 50*a*, 50*b* and the lower discharge rollers 52*a* to 52*d* of the second sheet member discharge mechanism 48, the sheet member 10 acts on the lower surface of the push-down member 120, whereby the push-down member 120 swings counterclockwise in FIG. 3 and arrives at the ascended position shown in FIG. 3. The ascended position varies depending upon the weight of the push-down member 120 that urges itself toward the descended position and upon the stiffness (so-called toughness) of the sheet member 10. Even at the ascended position, however, the push-down member 120 is extending toward the downstream being inclined downward from above the nipping portion between the upper discharge rollers 50*a*, 50*b* and the lower discharge rollers 52*b*, 52*c* down to below the nipping portion. Here, it is desired that the downstream end or the free end of the push-down member 120 is lower than the nipping portion between the upper discharge rollers 50*a*, 50*b* and the lower discharge rollers 52*b*, 52*c* but is higher than the center axis of the lower discharge rollers 52*a* to 52*d*. At the time when the push-down member 120 is brought to the ascended position, the upstream portion 126 on the lower surface of the push-down member 120 extends toward the downstream (toward the right in FIG. 4) being inclined downward at an inclination angle β1 which is desirably from 10 to 30 degrees, and the downstream portion 128 extends toward the downstream being inclined downward at an inclination angle 65 1 which is desirably from 20 to 60 degrees.

Figure 3:
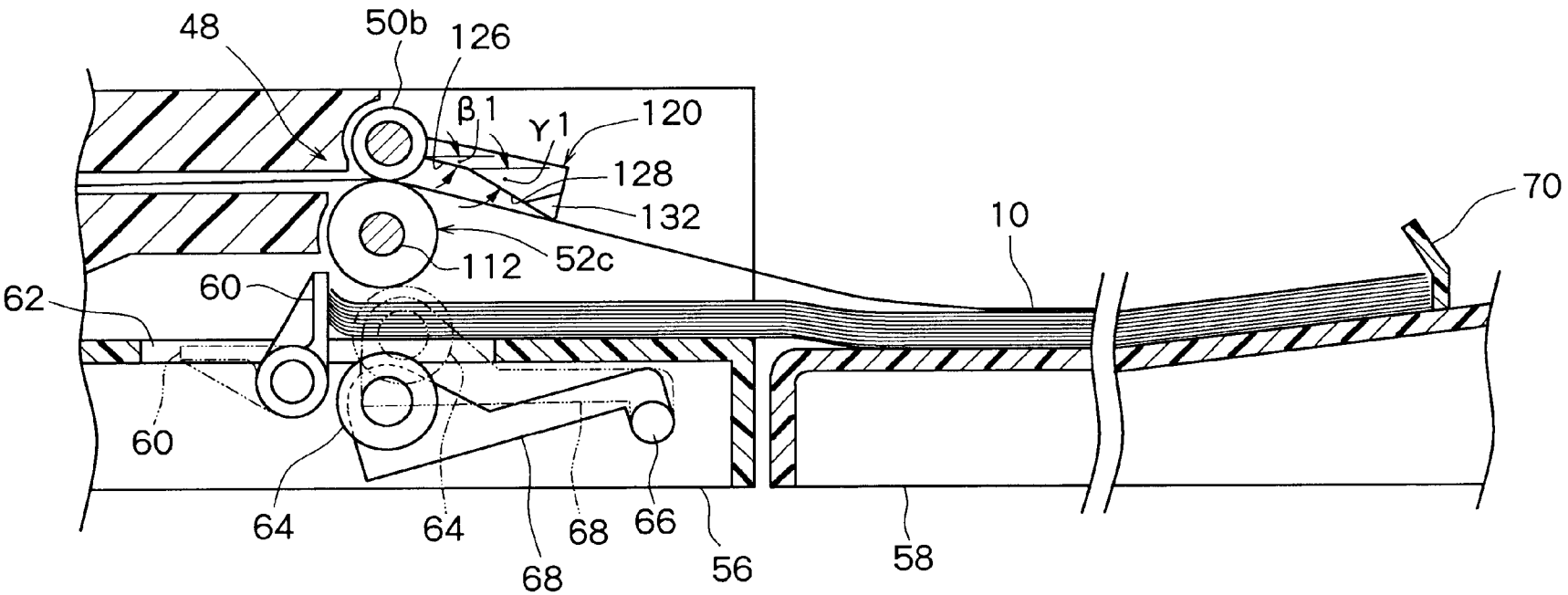
FIG. 3 is a sectional view illustrating a second sheet member discharge mechanism constituted according to the present invention in a state where a sheet member is being nipped between an upper discharge roller and a lower discharge roller in the image-forming machine shown in FIG. 1.
Figure 4:
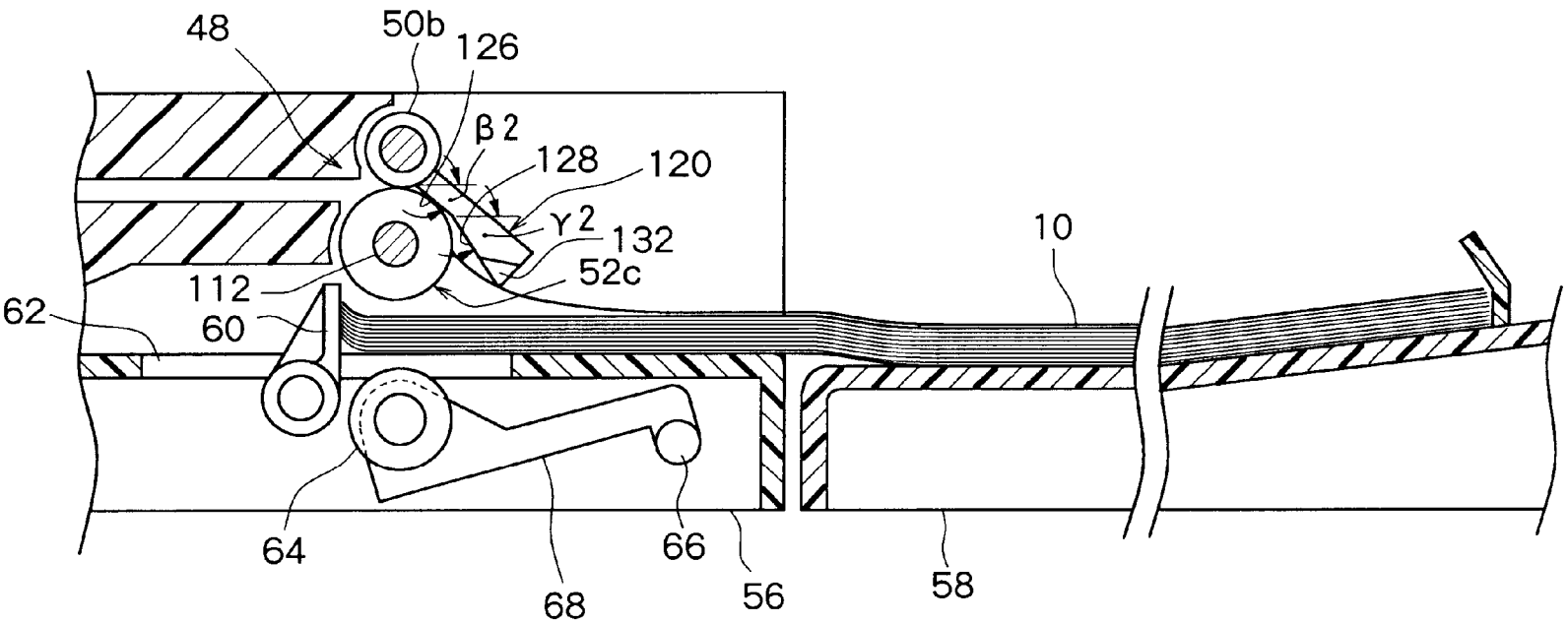
FIG. 4 is a sectional view illustrating the second sheet member discharge mechanism constituted according to the present invention in a state just after the trailing edge of a sheet member has passed the nipping portion between the upper discharge roller and the lower discharge roller in the image-forming machine shown in FIG. 1.

As the sheet member continues to be discharged and the trailing edge of the sheet member 10 passes the nipping portion between the upper discharge rollers 50*a*, 50*b* and the lower discharge rollers 52*b*, 52*c*, the force produced by the sheet member 10 for swinging the push-down member 120 counterclockwise in FIG. 3 decreases, and the push-down member 120 swings to the descended position shown in FIG. 4. Due to the push-down member 120 that swings, the trailing edge of the sheet member 120 is pushed down along the peripheral surfaces of the lower discharge roller 52*a* and 52*d*. This reliably prevents the trailing edge of the sheet member 10 from so staying as to cover the peripheral surfaces of the lower discharge rollers 52*a* to 52*d*, and the trailing edge of the sheet member 10 moves downward of the lower discharge rollers 52*a* to 52*d*. As will be easily understood with reference to FIG. 6, the trailing edge of the sheet member 10 can be moved downward of the lower discharge rollers 52*a* to 52*d* even in a manner that the steps 117*a* and 117*d* formed in the peripheral surfaces of the lower discharge rollers 52*a* and 52*d* come into engagement with the trailing edge of the sheet member 10 to forcibly move the trailing edge of the sheet member 10 along the peripheral surfaces of the lower discharge rollers 52*a* and 52*d*. According to experience by the present inventors, however, when no push-down member 120 is provided and, particularly, when the trailing edge of the sheet member 10 is curled upward, the trailing edge of the sheet member 10 is not brought into engagement with the steps 117*a*, 117*d* of the lower discharge rollers 52*a* and 52*d*; i.e., the trailing edge of the sheet member 10 tends to stay so as to cover the peripheral surfaces of the lower discharge rollers 52*a* to 52*d*. When the push-down member 120 is disposed, on the other hand, the trailing edge of the sheet member 10 is reliably moved downward of the lower discharge rollers 52*a* to 52*d* due to the action of the push-down member even when the trailing edge of the sheet member 10 is curled upward. In the diagramed embodiment, steps 117*a* and 117*d* are formed in the lower discharge rollers 52*a* and 52*d* in addition to providing the push-down member 120. If desired, however, the steps 117*a* and 117*d* may be omitted.

After predetermined number of pieces of sheet members 10 are discharged and stacked on the second sheet member receiving means 54, the sheet members 10 are moved in the direction of width as described above. Here, however, inclined surfaces 132 have been formed on both sides of the downstream end or the free end on the lower surface of the push-down member 120, the inclined surfaces 132 extending toward both side edges being inclined upward. Therefore, the side edges of the sheet members 10 do not come in contact with the side surface of the push-down member 120, and the sheet members 10 are smoothly moved in the direction of width without being hindered. In order to maintain smooth motion of the sheet members 10 in the direction of width, it is sufficient if the inclined surface 132 is formed on the inside only of each of the two push-down members 120 at the downstream ends in the lower surfaces thereof in the direction of width, instead of on both sides of the downstream end or the free end on the lower surface of the push-down members 120. In the diagramed embodiment, however, the inclined surfaces 132 are formed on both sides of the downstream end on the lower surface of the push-down member 120 in order to lower the production cost by constituting the two push-down members by using the members of the same shape.

In the foregoing was described in detail a preferred embodiment of the sheet member discharge mechanism constituted according to the present invention with reference to the accompanying drawings. It should, however, be noted that the invention is in no way limited to the above embodiment only but can be varied or modified in a variety of ways without departing from the scope of the invention.

What we claim is:

1. A sheet member discharge mechanism comprising an upper discharge roller and a lower discharge roller for conveying a sheet member while nipping it therebetween; wherein at least one push-down member is disposed downstream of the nipping portion between said upper discharge roller and said lower discharge roller as viewed in a direction of conveying the sheet member, said push-down member being allowed to move between an ascended position and a descended position and is urged to said descended position;

said push-down member is moved to said ascended position by said sheet member acting upon said push-down member while the sheet member is being conveyed by said upper discharge roller and said lower discharge roller that work in cooperation, and said push-down member moves to said descended position to push down the trailing edge of the sheet member after the trailing edge of the sheet member has passed the nipping portion between said upper discharge roller and said lower discharge roller; and said pushdown member has a width ending at end portions, and a lower surface, at least one of said end portions has a laterally inclined surface at a downstream end of said lower surface.

2. A sheet member discharge mechanism according to claim 1, wherein said push-down member is extending toward the downstream being inclined downward from above the nipping portion between said upper discharge roller and said lower discharge roller down to below the nipping portion thereof at both said ascended position and said descended position.

3. A sheet member discharge mechanism according to claim 2, wherein:

the lower surface of said push-down member includes an upstream portion and a downstream portion which extends toward the downstream being inclined downward at a predetermined bending angle α which is from 10 to 30 degrees with respect to said upstream portion;

when said push-down member is at said ascended position, said upstream portion on the lower surface of said push-down member extends toward the downstream being inclined downward at an inclination angle β1of from 10 to 30 degrees, and said downstream portion extends toward the downstream being inclined downward at an inclination angle γ1 of from 20 to 60 degrees; and when said push-clown member is at said descended position, said upstream portion on the lower surface of said push-down member extends toward the downstream being inclined downward at an inclination angle β2 of from 30 to 50 degrees, and said downstream portion extends toward the downstream being inclined downward at an inclination angle $\gamma 2$ of from 40 to 80 degrees.

4. A sheet member discharge mechanism according to claim 2, wherein when said push-down member is brought to said descended position, the tip of said push-down member is located at a position which is lower than a center axis of said lower discharge roller but is higher than the lowermost end of said lower discharge roller.

5. A sheet member discharge mechanism according to claim 4, wherein when said push-down member is brought to said ascended position, the tip of said push-down member is located at a position lower than said nipping portion between said upper discharge roller and said lower discharge roller but is higher than the center axis of said lower discharge roller.

6. A sheet member discharge mechanism according to claim 1, wherein said push-down member is urged to said descended position by its own weight.

7. A sheet member discharge mechanism according to claim 2, wherein said push-down member has nearly a rectangular shape and is formed of a synthetic resin.

8. A sheet member discharge mechanism according to claim 7, wherein ribs are formed on at least the upstream portion on the lower surface of said push-down member, the plural ribs extending in the direction of conveying the sheet member maintaining a distance in the direction of width.

9. A sheet member discharge mechanism according to claim 2, wherein said push-down member is mounted to swing about a center axis thereof which is substantially in agreement with the center axis of said upper discharge roller.

10. A sheet member discharge mechanism according to claim 9, wherein when said push-down member is brought to said descended position, the lower surface of said push-down member comes in contact with the lower discharge roller, whereby said push-down member is prevented from swinging in excess of said descended position.

11. A sheet member discharge mechanism according to claim 1, wherein said push-down members are arranged in a plural number maintaining a distance in the direction of width.

12. A sheet member discharge mechanism according to claim 1, wherein both of said end portions have an inclined surface at the downstream end of said lower surface.

* * * * *